United States Patent [19]

Probst

[11] Patent Number: 4,578,917

[45] Date of Patent: Apr. 1, 1986

[54] INTERLOCKING-SEGMENT SPACER BEAM

[75] Inventor: Gary A. Brobst, Norfolk, Nebr.

[73] Assignee: Nucor Corporation, Charlotte, N.C.

[21] Appl. No.: 673,205

[22] Filed: Nov. 20, 1984

Related U.S. Application Data

[63] Continuation of Ser. No. 433,541, Oct. 8, 1982, abandoned.

[51] Int. Cl.[4] ..... E04C 5/16

[52] U.S. Cl. ..... 52/478; 52/687

[58] Field of Search ..... 52/578, 579, 686, 687, 52/478–481, 688; 404/41

[56] References Cited

U.S. PATENT DOCUMENTS

| | | | |
|---|---|---|---|
| 946,890 | 1/1910 | Watson et al. | 52/735 |
| 985,891 | 3/1911 | Fox et al. | 52/374 |
| 1,623,252 | 4/1927 | Konrad | 52/374 |
| 1,961,488 | 6/1934 | Hedgcock et al. | 52/579 |
| 2,294,550 | 9/1942 | Greulich | 404/41 |

*Primary Examiner*—James L. Ridgill, Jr.

*Attorney, Agent, or Firm*—Shenier & O'Connor

[57] ABSTRACT

Spacing-beam segments formed from a single piece of sheet metal. Each segment is formed with a crowned horizontal portion and a depending spacer foot at one of the ends of the segment. Openings are formed on the horizontal beam portion adapted to receive lugs formed at the other end of the beam portion. The lugs interlock with the openings to join adjacent segments to form an elongated beam. The spacing feet provide a space between the surface supporting the feet and a floor or roof supported by the segmented beam.

2 Claims, 5 Drawing Figures

INTERLOCKING-SEGMENT SPACER BEAM

This application is a continuation of U.S. application Ser. No. 433,541 filed Oct. 8, 1982, now abandoned.

BACKGROUND OF THE INVENTION

In the construction of buildings, it is frequently desirable to provide a space between the roof of the building and the ceiling of the uppermost floor. This space may be utilized for the positioning of electrical wiring, water piping, air-conditioning conduits, heat insulation, and the like. Likewise, it may be desirable to position a false floor over a subfloor to provide a space for similar purposes. In the prior art, a continuous beam has been used. For example, this beam was supported by a joist or purlin, which was part of the roof assembly, by a plurality of spacing members attached to the purlin and supporting the beam. Clips, or spacing members, were then attached to the beam which supported the roof and also secured it to the building. In pre-engineered buildings, it is desirable to reduce the extent of labor required at the building site. Time is consumed in placing and securing spacing members to the joist or purlin and also attaching them to the beam which they are to support. The use of a one-piece construction for each of the segments of the beam eliminates separate spacing members, which results in savings, not only in manufacturing and inventory, but in shipping and erection costs.

FIELD OF THE INVENTION

My invention relates to a spacing beam in which the spacing members are formed integrally with segments which may be readily assembled into an elongated supporting beam.

DESCRIPTION OF THE PRIOR ART

The prior art employed a continuous beam with separate spacing members.

SUMMARY OF THE INVENTION

My invention contemplates a one-piece construction in which an elongated spacing beam is formed of a plurality of segments, each of which has an integral spacing member at one end thereof. This eliminates separate spacing members and bridge beams. Savings are achieved in the manufacture of the segments and in the reduction of inventory, since varying lengths can be readily made by assembling segments. I provide one fastening means for each segment, which will lock the beam into position and furnish both lateral and vertical stability for the assembled beam. The spacing members are provided with stiffeners. These furnish resistance to rotation in a longitudinal direction. Each subsequent beam section is supported at its free end by the vertical stiffeners of the prior beam section and is restrained from lifting by interlocking with the prior beam section. Locking tabs provide a uniform increment of spacing from beam to beam. This furnishes a constant spacing between the attachment points, allowing use on systems requiring modularity between units. All the segments are the same, which greatly reduces inventory. Each beam is crowned for strength. In starting an assembled beam, the first unit may be field cut to any desired length, so long as the spacing unit or foot portion of the segment remains, so that additional segments may be secured to it and to each other as the formation of the completed beam takes place.

OBJECTS OF THE INVENTION

One object of my invention is to provide a one-piece construction of a beam segment having integrally formed therewith spacing or standoff portions.

Another object of my invention is to provide means for readily assembling a plurality of beam segments to form an elongated beam composed of a plurality of such segments.

A further object of my invention is to provide an elongated beam having integral spacing members depending therefrom, formed of a plurality of interlocking segments.

Other and further objects of my invention will appear from the following description.

BRIEF DESCRIPTION OF THE DRAWINGS

In the accompanying drawings, which form part of the instant specification and which are to be read in conjunction therewith, and in which like reference numerals are used to indicate like parts in the various views.

DESCRIPTION OF THE PREFERRED EMBODIMENT

Figure 1:
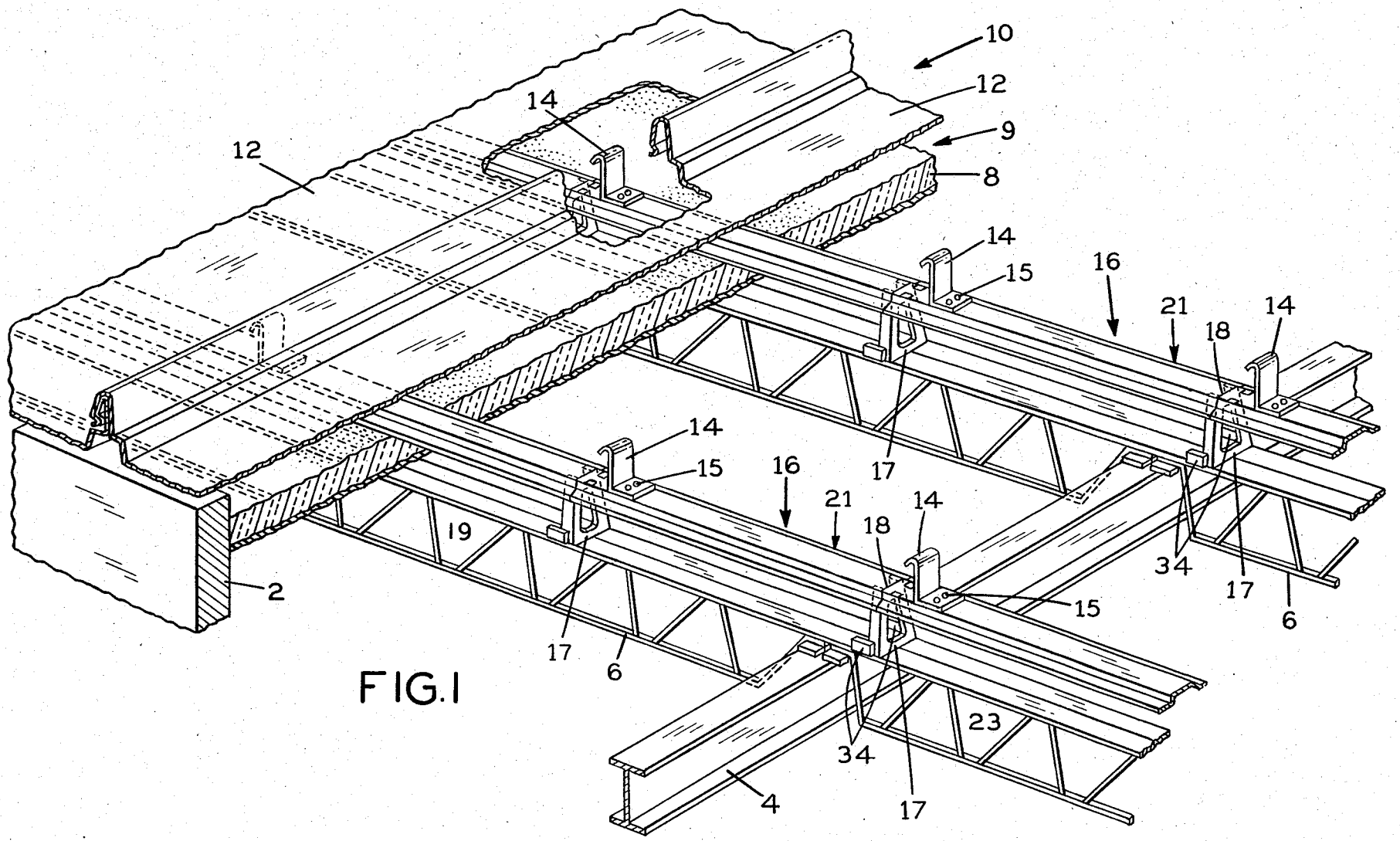
FIG. 1 is a perspective view with parts in section, showing the interlocking-segment spacer beam of my invention as applied to a section of a standing seam metal roof.

Referring to FIG. 1, a wall 2 of a building (not shown) supports a plurality of beams 4 (only one of which is shown). These beams usually extend transverse of the length of the building to be erected. The beams support joists or purlins 6 which run longitudinally of the building. It is to be understood, of course, that the orientation may be changed, if desired. The spacer beams, indicated generally by the reference numeral 16, are formed of segments 21 with integrally depending spacer feet or standoff portions 17. The assembled spacer beam 16 supports the metal roof, indicated generally by the reference numeral 10, formed of metal panels 12. Clips 14, secured to each segment 21 of the spacer beam by self-tapping screws 15, hold the roof against uplift from wind gusts. An insulation batt 8 is supported between joists 6. It will be seen, by reference to FIG. 1, that an air space 9 is provided between the top of the insulating batt and the roof 10. In the construction shown in FIG. 1, the air space is employed as an additional insulating area, increasing the efficiency of heat transfer between the interior of the building and the exterior of the metal roof.

Figures 2, 3, 4:
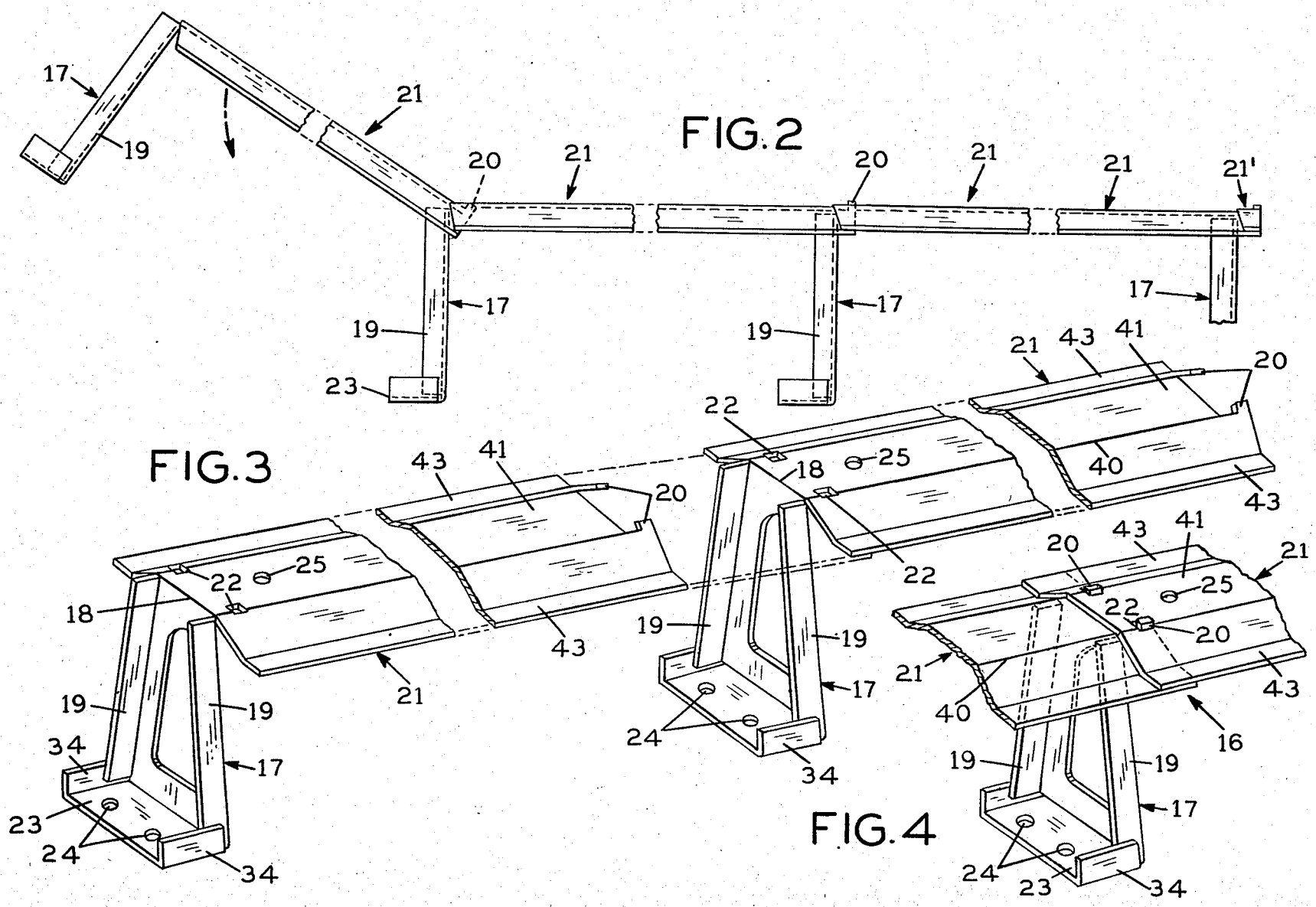
FIG. 2 shows a portion of an interlocking-segment spacer beam, with one segment being added to a plurality of previously assembled sections.
FIG. 3 is a perspective view, showing a segment before being assembled with another segment.
FIG. 4 is a view similar to FIG. 3, showing adjacent segments assembled.

Referring now to FIG. 2, the beam 16 is formed of a plurality of segments 21, shown in greater detail in FIGS. 3 and 4. In FIG. 2, the right-hand segment 21' has most of its length removed, leaving only its spacer section 17' remaining. This enables a segment 21 to be interlocked with the truncated segment. Another segment is then interlocked with the assembly in the manner shown in the drawing.

Referring now to FIGS. 3 and 4, the end of each segment is provided with integral lugs 20 which are adapted to interlock with holes 22 formed at the opposite end of each segment 21. By tilting the segment upwardly and inserting the ends of the lugs 20 into the holes 22, the segment can be rotated in a counterclockwise direction, as shown in FIG. 2, to interlock the adjacent segments 21 as shown in FIG. 4. Each segment 21 is bent downwardly along the line 18 to form an integral spacer foot or standoff portion 17. The bottom of the spacer or standoff portion 17 is provided with a horizontal portion 23. Holes 24 in the horizontal portion 23 are adapted to receive self-tapping screws, or the like, to secure each segment to the joist or other support. The spacer portion 17 is provided with reinforcing flanges 19 which stiffen the spacer portion 17. Each segment 21 is provided with a pilot hole 25 to enable accurate modular assembly.

Figure 5:
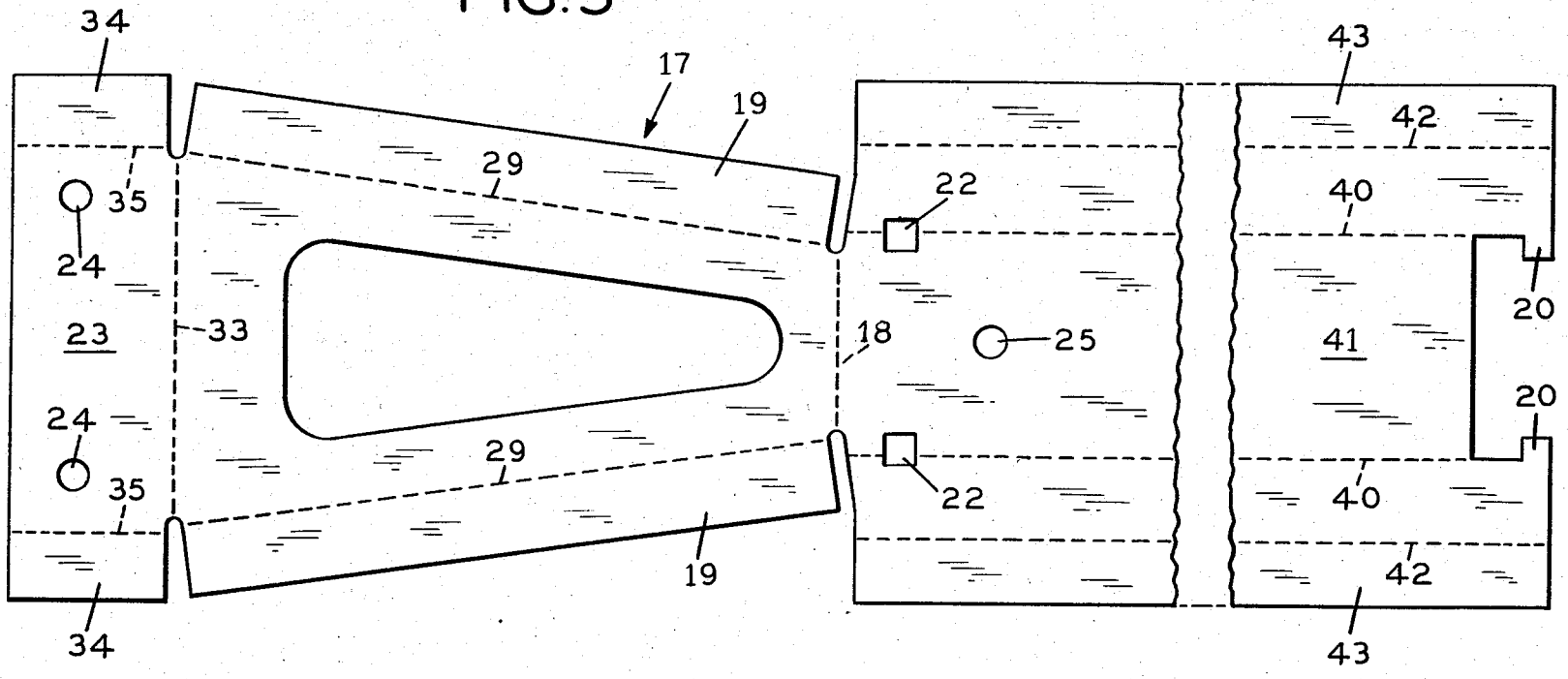
FIG. 5 is a view, with parts broken away, of a sheet-metal stamping adapted to be bent to form the spacer beam of my invention.

Referring now to FIG. 5, the dotted lines indicate the regions along which bending takes place to form the interlocking beam of my invention. The spacer or standoff portion, indicated generally by the reference numeral 17, is formed by bending one end of the metal matrix downwardly through 90° along the line 18. The flanges 19 are formed by bending the metal upwardly through 90° along the lines 29. The horizontal portion or base 23 is formed by bending the matrix upwardly through 90° along the line 33. The side tabs 34 of the horizontal portion or base 23 are formed by bending the tabs upwardly along the lines 35. The crown portion 41 of the beam, as can readily be seen by reference to FIGS. 3 and 4, is formed by bending the matrix along the lines 40 downwardly through approximately 64°, while the horizontal portions 43 of the crown are formed by bending the edges upwardly along the lines 42 through the same angle of approximately 64°. When the parts have been bent as described, my improved segment, of which the segmented spacing beam may be formed, has been completed.

Each segment is made of a single piece of heavy-gauge metal. In other words, the entire assembly is an integral section or segment which may be interlocked with another identical segment to form an elongated spacer beam adapted to space the roof of a building from a ceiling, or a floor from a subfloor, to provide an air space therebetween.

It will be seen that I have accomplished the objects of my invention. I have provided a segment formed of a single piece of heavy-gauge metal which is adapted to be interlocked to form a continuous beam with depending spacer or standoff elements. Each segment is identical to each other segment, thus dramatically reducing inventory since one species of segment need be stocked. When the beam is in place, one fastening means for each section provides both lateral and vertical stability for the beam. Each of the spacing or standoff sections are integrally stiffened and bear against the bottom attachment plate which is also integral. Each subsequent beam section, when assembled, is supported at its free end by the vertical stiffeners on the prior beam and interlocked therewith.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A spacing-beam segment adapted to be interlocked with an identical segment to form an elongated segmented spacing beam having spacer feet for supporting said segmented beam a distance away from a weight-bearing surface including in combination a horizontal beam portion, said horizontal beam portion being formed with a crown, an integral spacer foot extending downwardly therefrom at one end thereof and formed with a horizontal flange, openings formed in said horizontal beam portion adjacent said one end, and integral lugs formed adjacent the other end of said horizontal beam portion, said lugs adapted to cooperate with said openings in another identical contiguous beam segment to interlock the two identical segments to form an elongated segmented spacing beam.

2. An elongated segmented spacing beam formed of a plurality of identical interlocked segments, each segment comprising a horizontal beam portion, an integral spacer foot extending downwardly therefrom at one end thereof and formed with a horizontal flange, openings formed in said horizontal beam portion adjacent said one end, and integral lugs formed adjacent the other end of said horizontal beam portion, said lugs adapted to cooperate with said openings in another identical contiguous beam segment to interlock the two identical segments to form said elongated segmented spacing beam.

* * * * *